US011439867B1

(12) United States Patent
Sama

(10) Patent No.: US 11,439,867 B1
(45) Date of Patent: Sep. 13, 2022

(54) SOLE FLO BALANCE BOARDS

(71) Applicant: Pat Sama, N. White Plains, NY (US)

(72) Inventor: Pat Sama, N. White Plains, NY (US)

( * ) Notice: Subject to any disclaimer, the term of this patent is extended or adjusted under 35 U.S.C. 154(b) by 0 days.

(21) Appl. No.: 16/732,551

(22) Filed: Jan. 2, 2020

(51) Int. Cl.
*A63B 22/16* (2006.01)

(52) U.S. Cl.
CPC ..... *A63B 22/16* (2013.01); *A63B 2208/0204* (2013.01); *A63B 2209/10* (2013.01)

(58) Field of Classification Search
CPC ..... A63B 22/14; A63B 22/16; A63B 22/18; A63B 2022/185; A63B 26/003; A63B 21/0004; A63B 21/065; A63B 21/068; A63B 21/22; A63B 21/222; A63B 21/227; A63B 21/4001; A63B 21/4011; A63B 21/4013; A63B 21/4015; A63B 21/4017; A63B 21/4019; A63B 21/4023; A63B 21/4025; A63B 21/4033; A63B 21/4034; A63B 21/4035; A63B 21/4039; A63B 21/4041; A63B 21/4043; A63B 21/4047; A63B 21/4049; A43B 3/12; A43B 3/122; A43B 3/124; A43B 3/16; A43B 3/128
See application file for complete search history.

(56) References Cited

U.S. PATENT DOCUMENTS

| | | | | |
|---|---|---|---|---|
| 5,339,542 | A * | 8/1994 | Kim | A43B 5/18 36/132 |
| 6,421,935 | B1 * | 7/2002 | Bartlett | A43B 13/143 482/79 |
| 7,500,324 | B1 * | 3/2009 | Power | A43B 13/145 482/79 |
| 8,740,757 | B1 * | 6/2014 | FioRito | A63B 22/18 482/79 |
| 9,713,360 | B2 * | 7/2017 | Santos | A63B 22/18 |
| 10,639,517 | B2 * | 5/2020 | Griffin | A63B 21/4034 |
| 2004/0118016 | A1 * | 6/2004 | Tonkel | A43B 3/102 36/11.5 |
| 2005/0137511 | A1 * | 6/2005 | Bailar | A43B 13/145 482/79 |
| 2008/0016722 | A1 * | 1/2008 | Battaglino | A63B 22/16 36/114 |
| 2012/0178068 | A1 * | 7/2012 | Breach | A43C 11/146 434/247 |
| 2013/0116726 | A1 * | 5/2013 | Mor | A43B 7/147 606/204 |

* cited by examiner

*Primary Examiner* — Nyca T Nguyen
*Assistant Examiner* — Zachary T Moore

(57) ABSTRACT

Sole Flo Balance Boards relates to balance boards and solves the problem of not being able to move around when using a balance board. These balance boards provide one with the ability to practice balancing while moving. Sole Flo Balance boards uses hook and loop cinch straps that are attached to the board so that a person can fasten the boards to their feet and therefore move into different position while trying to maintain and develop their balance.

1 Claim, 9 Drawing Sheets

SOLE FLO BALANCE BOARDS

CROSS-REFERENCE TO RELATED APPLICATIONS

This application claims the benefit of priority of U.S. Provisional patent application No. 62/819,814, filed Mar. 18, 2019 which is herein incorporated by reference.

SUMMARY OF THE INVENTION

Sole Flo balance boards are a set of two flat boards with a ridged hemisphere attached to the center of the bottom of each of the boards. Straps are attached to the boards so that the board can be fastened to the feet of the person using it. The person may or may not need to wear sneakers/shoes to use the balance boards. The method by which the board is fastened to a person can be my means of hook and loop, nylon straps or any other device such as buckle or other means that allows the board to stay in contact with and or move with the person using it. The board and hemisphere may be made of different materials and may be of different sizes. For example, the board may be six inches by nine inches by a half inch and made of wood. The corners of the board may or may not be rounded. The hemisphere may or may not be made of a ridged polyurethane resin or plastic.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention relates to balance boards and more particularly to balance boards that can be fasted to a person's feet whether or not they are wearing shoe or sneakers and as such so that the balance board moves with the person as the person moves their feet. Balance boards in generals are just stood on and do not allow the person standing on it the ability to move around, but just remain mostly in the same area when using the balance board. Balance boards do not allow a person to lift their foot off a balance board and maintain contact the balance board itself in order to practice on a balance board with movement.

BRIEF SUMMARY OF THE INVENTION

The Sole Flo Balance Board solves the problem of not being able to move around while on a balance board by providing the ability to fasted the balance board to one's feet. This can be accomplished through the use of hook and loop straps, nylons straps, or any other material that can be used to fasten the balance board to a person's feet so that they are able to move around while using the balance board. By being able to move around while attached to a balance board, a person is able to practice balancing while moving. Something that is not currently attainable with a regular balance board.

DETAILED DESCRIPTION OF THE INVENTION

Figure 1:
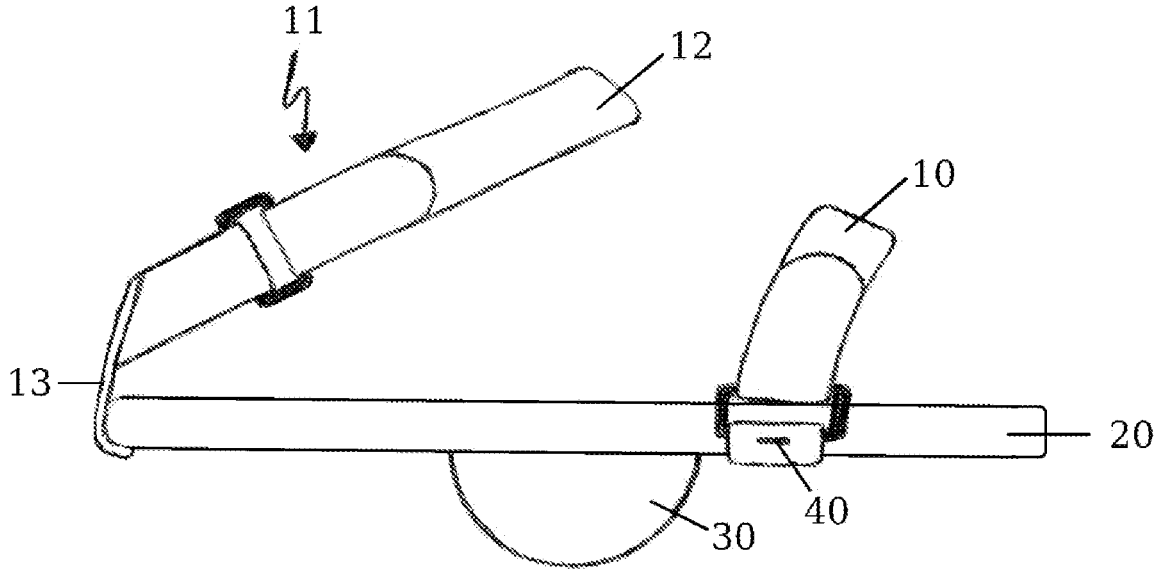
FIG. 1 is a side view of the product showing the front-end and back-end hook and loops cinch straps
Figure 2:
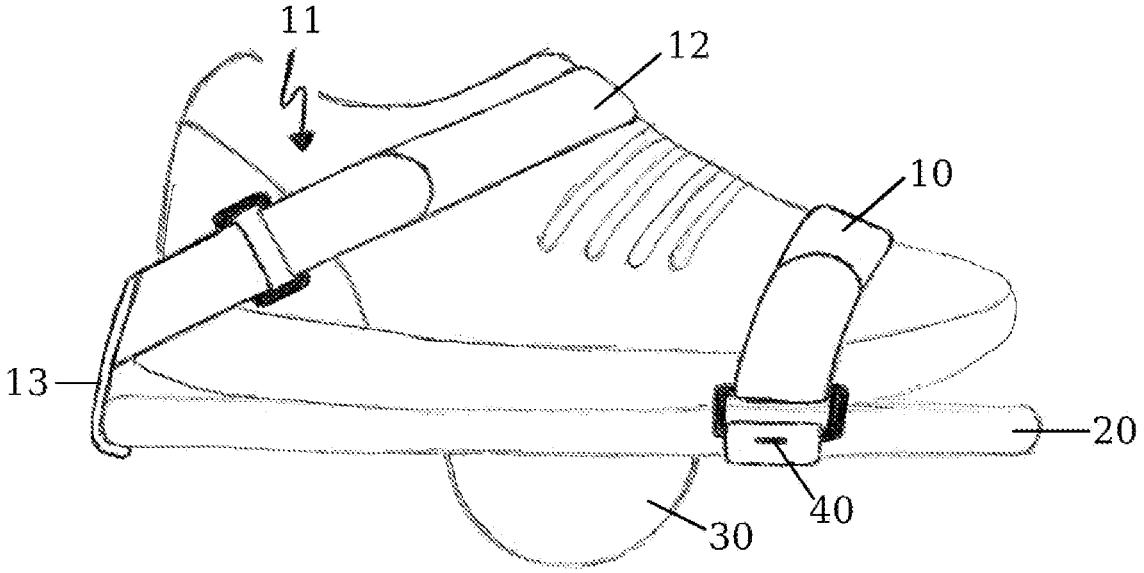
FIG. 2 is a side view of the product with a sneaker on it showing the front-end and back-end hook and loops straps that can be used to fasten the board to a shoe one may be wearing using hook and loop cinch straps
Figure 3:
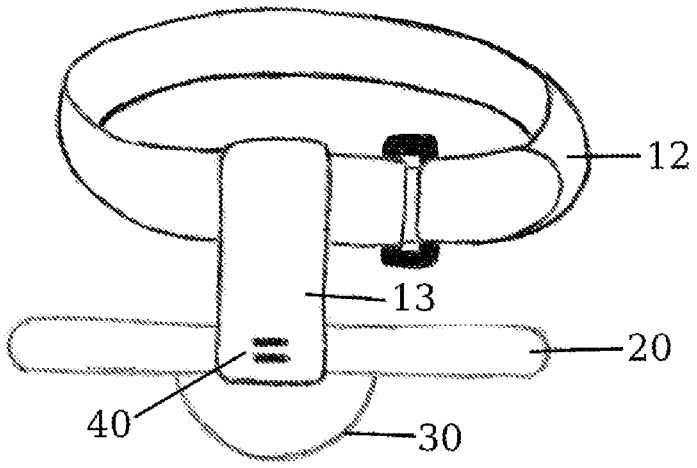
FIG. 3 is a back view of the product showing the rear loop and the back-end look and loop cinch strap.
Figure 4:
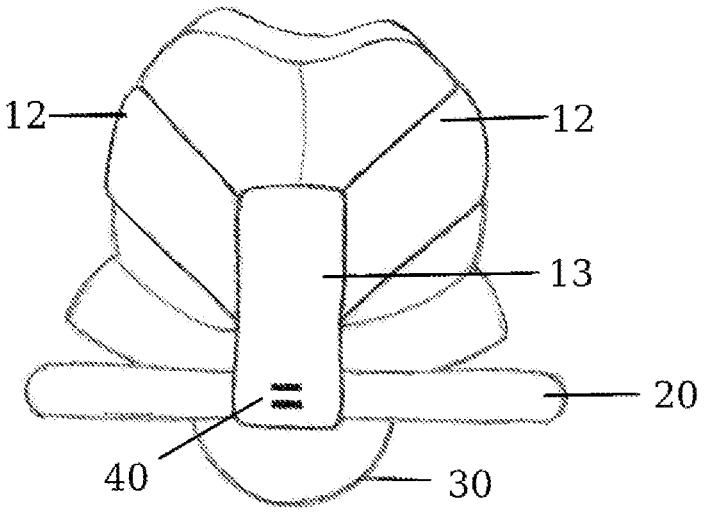
FIG. 4 is a back view of the product with a sneaker on it showing the rear of the back-end loop that can be used to fasten the board to a shoe one may be wearing using hook and loop cinch straps
Figure 5:
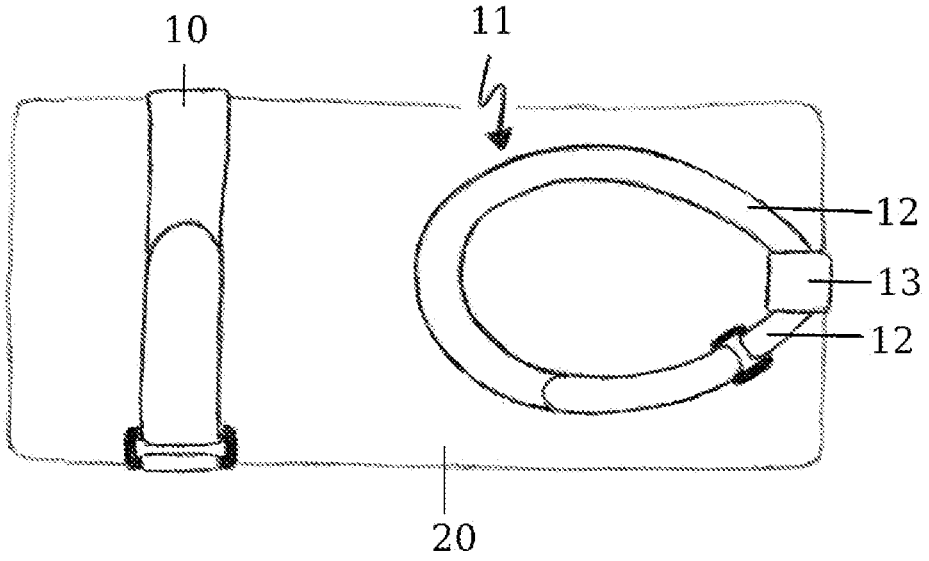
FIG. 5 is a top view of the product showing the front-end and back-end hook and loops cinch straps.
Figure 6:
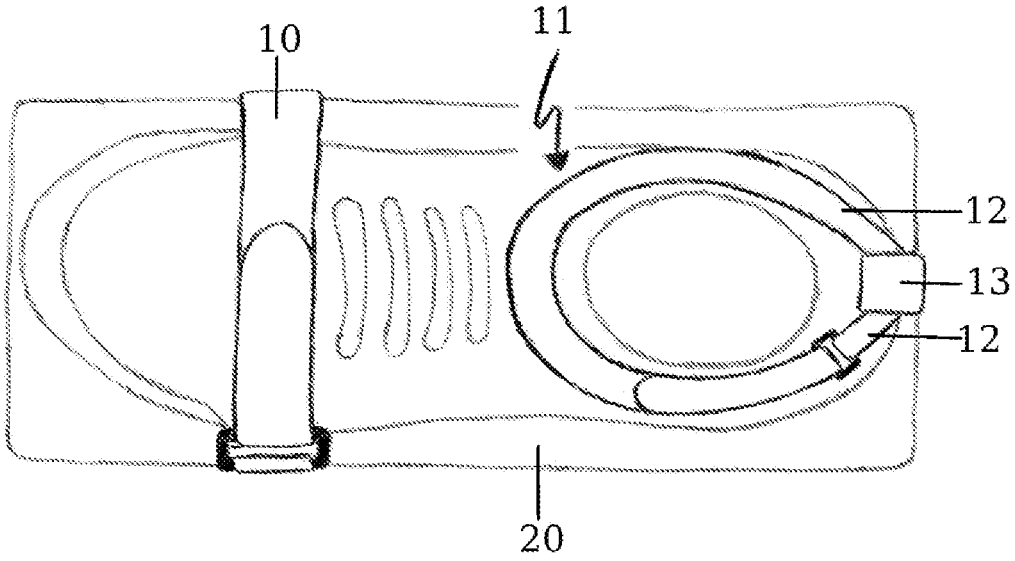
FIG. 6 is a top view of the product with a sneaker on top showing the front-end and back-end loops that can be used to fasten the board to a shoe one may be wearing using hook and loop cinch straps
Figure 7:
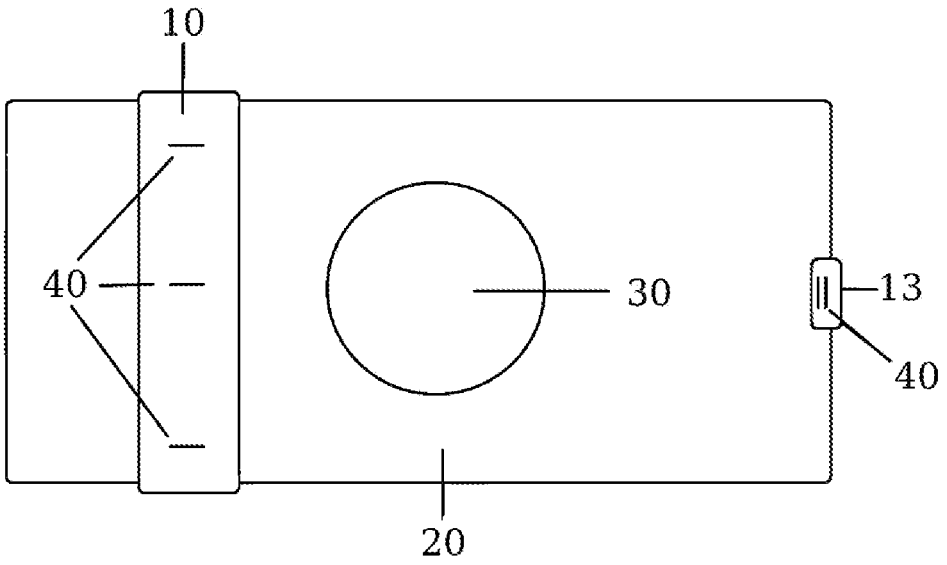
FIG. 7 is a bottom view of the product showing how the front-end hook and loop cinch strap is attached and wraps around the board.
Figure 8:
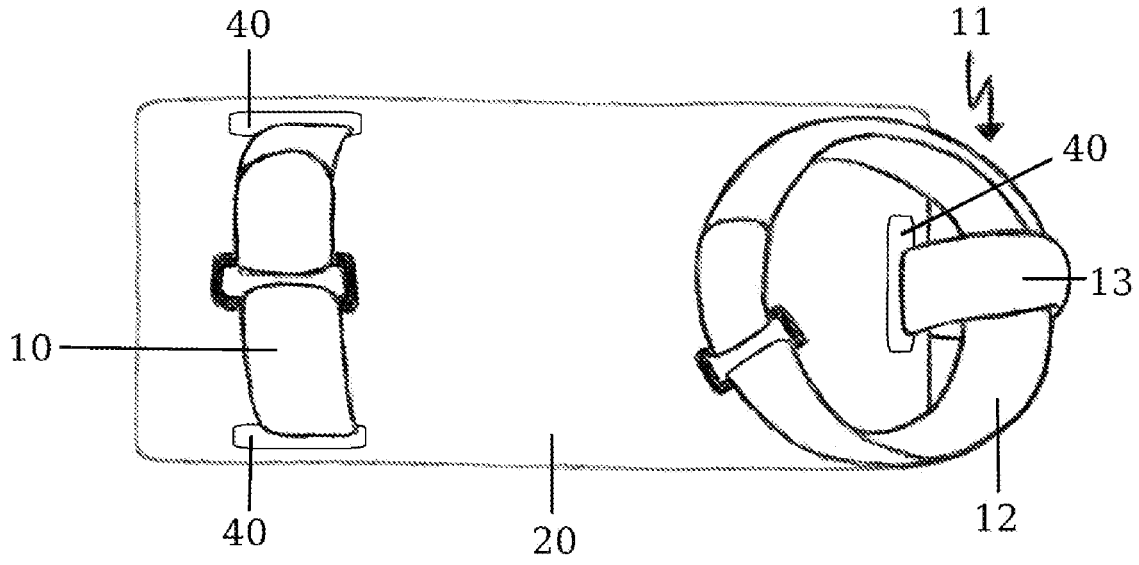
FIG. 8 is a top view of the product showing how straps can be threaded through slots in the board.
Figure 9:
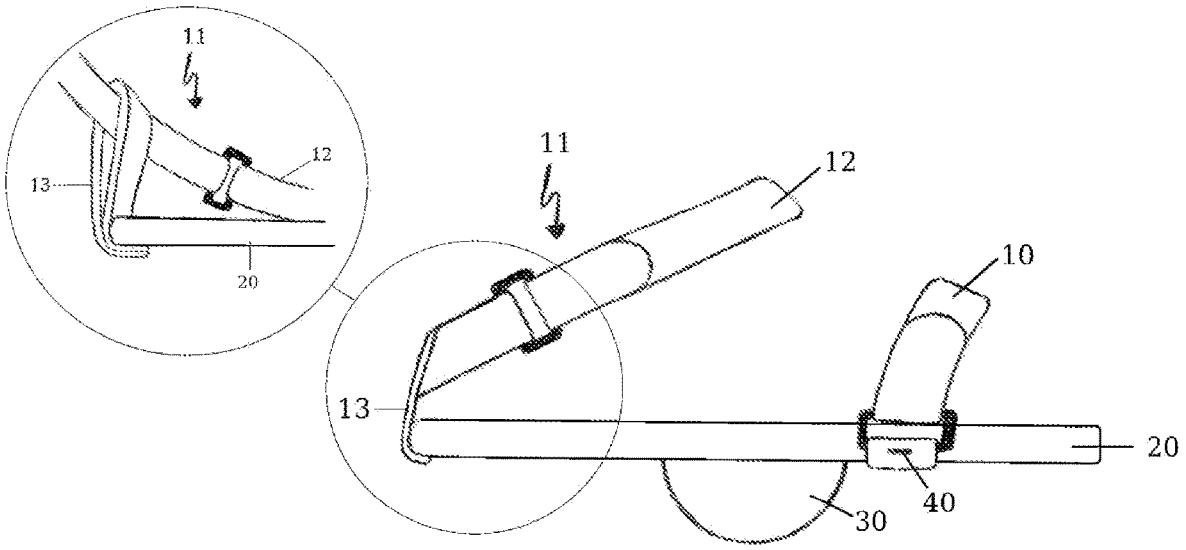
FIG. 9 is a side view of the rear loop strap and how the back-end hook and loop cinch strap threads through the rear loop.

The Sole Flo Balance Board makes it possible to train on a balance board and, unlike other balance boards, allow you to move around without losing contact with the balance board itself. As illustrated in FIG. 1, FIG. 2, FIG. 3, FIG. 4, FIG. 5 and FIG. 6, The balance board consists of a front-end harness comprised of a hook and loop cinch strap 10 and a back-end harness 11 consisting of a hook and loop cinch strap 12 that is attached to the rear loop 13 that is attached to the board 20, The harnesses 10,11 allow the board to be securely fastened to the feet/shoe of the person using it. Two straps are utilized to ensure that the board is securely fastened in the front and in the back so that the board stays firmly in place and doesn't shift out of position. As FIG. 7 illustrates, the front-end strap 10 is attached to the board in a way that it wraps around the board. This allows the strap to be adjusted and tightened around a person's foot or shoe and allows for the excess strap to be secured neatly around the board. As FIG. 8 illustrates, the back-end strap 12 is threaded through the rear loop 13 that is attached to the board. This allows the back-end hook and loop strap to move freely allowing a person the better adjust and tighten the back-end strap. The balance board itself consists of two 6-inch by 9-inch boards 20 with a ridged hemisphere 30 attached to the center of the bottom of the board. As illustrated in FIG. 1, FIG. 3, FIG. 7, the straps are attached to the board by staples 40, but may also be attached to the board by other means such as adhesives, nails, or screw or as FIG. 9 illustrates, the straps 10,11 may also be threaded through slots 40 in the board 20 as to avoid being physically attached to the board yet still wrap around the board so that it can be secured around a person's foot or shoe. The straps themselves are a hook and loop cinch strap 10,12, but a strap with a buckle or any other device that allows one to secure the board to the person's feet/sneaker/shoe may or may not be used.

I claim:

1. An exercise device for controlling balance while in motion comprising:

a board with a flat upper and flat lower surface sized and configured to fit a user's shoe on the upper surface, wherein the board has a front portion with a first slot therethrough and a second slot at a center of a rear end of the board therethrough;

a semispherical shaped object attached to a center of the flat lower surface;

an adjustable front hardness looped through the first slot and configured to wrap around the user's shoe; and a back strap looped through the second slot, wherein an adjustable back harness is looped through an upper end of the back strap and configured to loop around the user's shoe.

* * * * *